US006343436B1

(12) United States Patent
Milano, Jr. et al.

(10) Patent No.: US 6,343,436 B1
(45) Date of Patent: Feb. 5, 2002

(54) SLIDING SASH DRIVE ASSEMBLY

(75) Inventors: Arthur J. Milano, Jr., Burlington; Herman J. Parent, Winsted, both of CT (US)

(73) Assignee: Seitz Corporation, Torrington, CT (US)

( * ) Notice: Subject to any disclaimer, the term of this patent is extended or adjusted under 35 U.S.C. 154(b) by 0 days.

(21) Appl. No.: 09/699,969

(22) Filed: Oct. 30, 2000

(51) Int. Cl.[7] ..... E05F 11/40
(52) U.S. Cl. ..... 49/362; 49/139; 74/396
(58) Field of Search ..... 49/139, 140, 360, 49/362, 425; 192/20; 74/396, 406, 422

(56) References Cited

U.S. PATENT DOCUMENTS 130,542 A * 8/1872 Shumusk
193,418 A * 7/1877 Morris
3,324,594 A * 6/1967 Hettinger et al.
3,469,345 A * 9/1969 Hanks
3,736,702 A * 6/1973 Pickles ..... 49/362
4,165,583 A * 8/1979 Meyer ..... 49/349
4,167,834 A * 9/1979 Pickels ..... 49/358
5,701,211 A * 12/1997 Perry et al. ..... 359/873

* cited by examiner

*Primary Examiner*—Curtis A. Cohen
(74) *Attorney, Agent, or Firm*—Dallett Hoopes

(57) ABSTRACT

This sliding sash drive assembly includes a rack gear for the sash and a drive unit adapted to be mounted on the window frame and having a driven spur gear. An L-shaped engagement lever is mounted at its vertex on the housing and carries on its short leg a rack guide adapted to embrace the rack gear so that, as the long leg of the lever is moved, the guide moves the rack to a position at which the rack meshes with the spur.

9 Claims, 3 Drawing Sheets

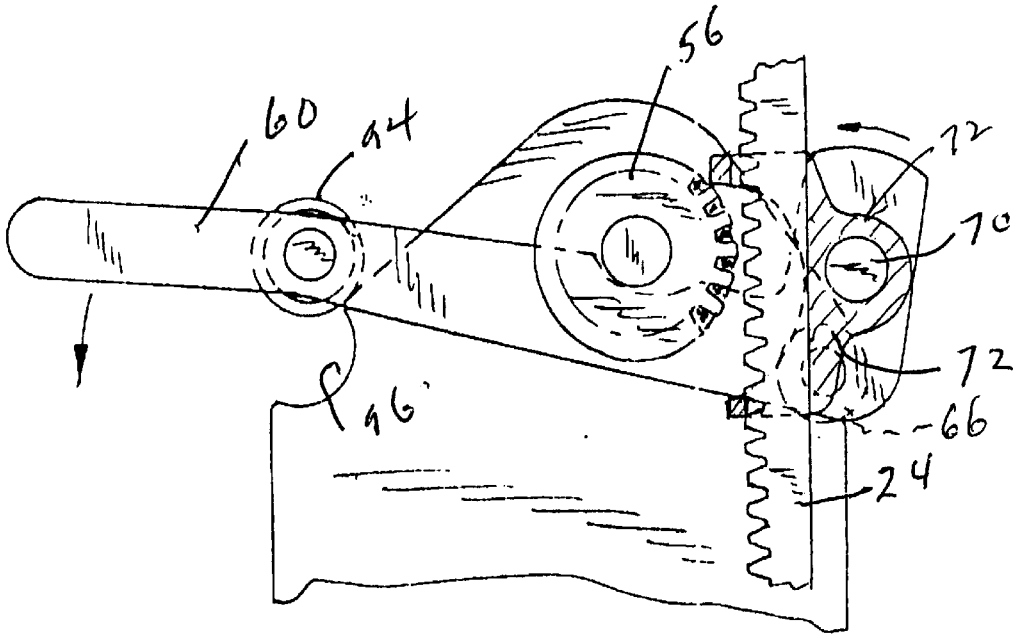
FIG. 3A
FIG. 3B
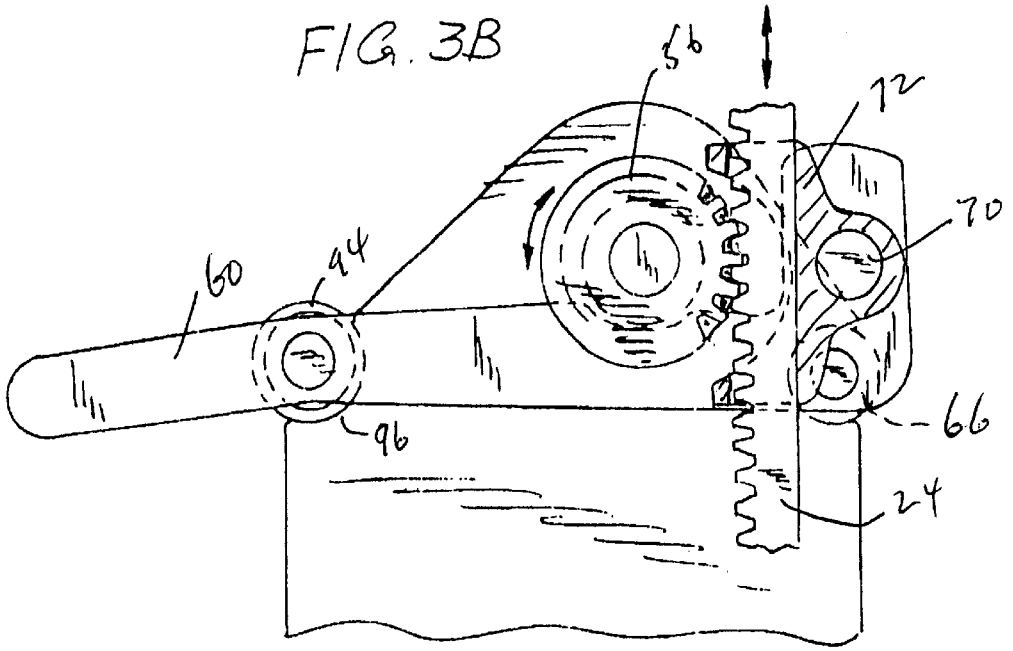

SLIDING SASH DRIVE ASSEMBLY

FIELD OF THE INVENTION

This invention relates to a sash drive assembly for sliding sashes.

BACKGROUND OF THE INVENTION

Sashes of the sliding type are often heavy or sticking and are often tightly held by sealing tracks so that especially weak or infirm persons need means for operating them.

SUMMARY OF THE INVENTION

The invention is a self-contained drive assembly for sliding sash windows. It comprises a rack gear adapted to be connected to the sash parallel to the direction of sash movement and a drive unit adapted to be mounted on a widow frame element associated with a sash and extending in the same direction. The drive unit comprises a housing containing a drive motor and output spur. It also comprises an L-shaped engagement lever pivotally attached to the housing at its vertex and a rack guide pivotally attached to the L-shaped engagement lever on the short arm of the "L". By manipulating the long arm of the L-shaped lever, the user can move the guide to position the rack against the spur gear in a firm but releasable way so that when the motor in the housing is activated, the spur drives the rack and, hence the sash, up or down. Batteries for the motor and controls may be provided in the housing.

BRIEF DESCRIPTION OF THE DRAWINGS

Further objects and features of the invention will be clear to those skilled in the art from a review of the following specification and drawings, all of which present a non-limiting form of the invention. In the drawings:

FIG. 3A is an enlarged fragmentary view showing the drive assembly in free condition with the spur disengaged from the rack; and FIG. 3B is comparable to FIG. 3A but showing the drive assembly in operative condition with the spur engaging the rack.

DESCRIPTION OF THE PREFERRED EMBODIMENT

Figure 1:
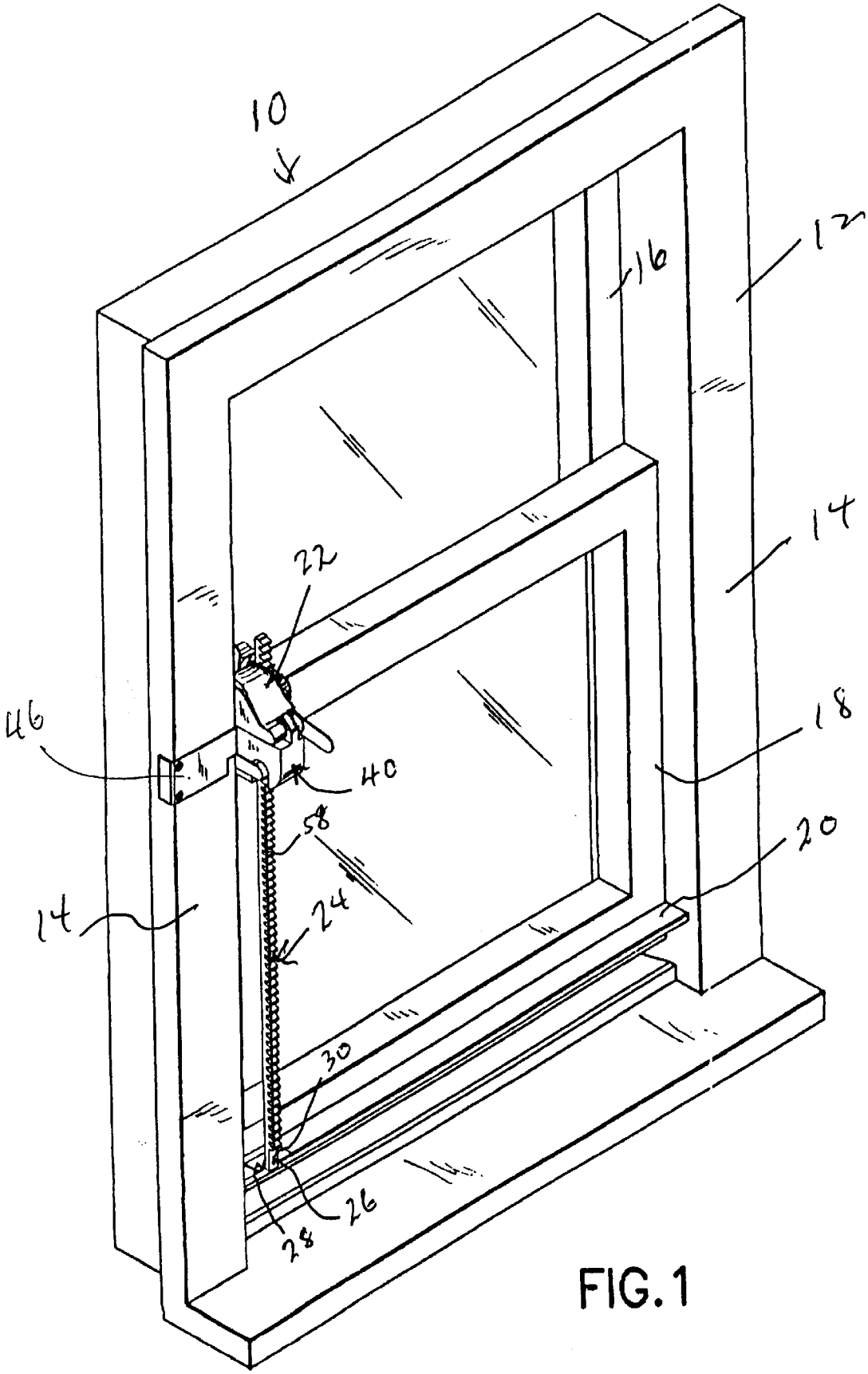
FIG. 1 is a perspective view taken from the left side and in front and showing an embodiment mounted on a window.

A window having a drive assembly of the invention is generally designated 10 in FIG. 1. It comprises a frame 12 having vertical side elements 14 and an upper sash 16 and a lower sash 18 which travel on vertical tracks, not shown. The lower sash has a lower horizontal element which is formed with a fixed horizontal shelf 20. The drive assembly 22 comprises a rack gear 24 having a lower end 26 which is attached by a bracket 28 secured to the shelf 20. The bracket includes an attachment fastener 30 at the lower end 26 of the rack and secures the rack from vertical displacement with respect to the sash 18 but permits limited pivoting in a vertical plane perpendicular to the sash 18.

The assembly 22 also includes a drive unit 40. The drive unit 40 includes a housing 42 (FIG. 2) which contains a motor (not shown) having a shaft which terminates in a drive hub 44.

A mounting bracket 46 is provided and comprises a flat plate 48 having a plurality of tubular spacers 50 having threaded bores, the distal ends of the spacers being secured to the housing 42 by fasteners (not shown). Perpendicular to the plate 48 is a mounting strip 52 suitably apertured for securement to the vertical element 14 of the window frame (FIG. 1). A positioning foot 54 on the strip 52 is adapted to engage the outer side of the frame element 14.

The controls for the motor within the housing 42 which are used to control direction and speed of the motor, as well as the battery which may also be disposed in housing 42, are not shown. A spur gear 56 is mounted on the drive hub 44 by means not shown to rotate therewith. The pitch of the teeth of the spur gear 56 and teeth configuration are such as to mesh with the teeth of the rack 24.

An L-shaped engagement lever 60 (FIG. 2) having a longer leg 62 and a shorter leg 64 is provided with a spindle 66 at the vertex of the "L". A threaded fastener, not shown, may extend through an opening 67 in the lever 60, through the spindle 66 into the mounting flange 68 of the housing and into the threaded spacer 50 aligned therewith. Thus, the lever 60 is pivoted about the axis of the spindle 66.

Positioned on the short arm of the lever is a shaft 70 having an axis parallel to the axis of the gear 56. A rack guide 72 being generally a U-shaped element, is formed with an integral boss 74 apertured at 76, the aperture 76 pivotally receiving the shaft 70 which provides for the pivoted mounting of the rack guide 72. The legs of the "U" of the U-shaped guide are formed with slots 84 from one side, the slots being of a dimension to embrace the rack 24 from both front, the left (FIG. 2) and behind, the rack being trapped on the opposite sides by the lever 67 so that the rack, when the guide is in place, is relatively immobilized. The shaft 70 is formed with a peripheral groove which carries an O-ring 90 for releasably retaining the guide on the shaft 70. The guide can be removed from the shaft by forcefully pulling it past the O-ring 90.

Figure 2:
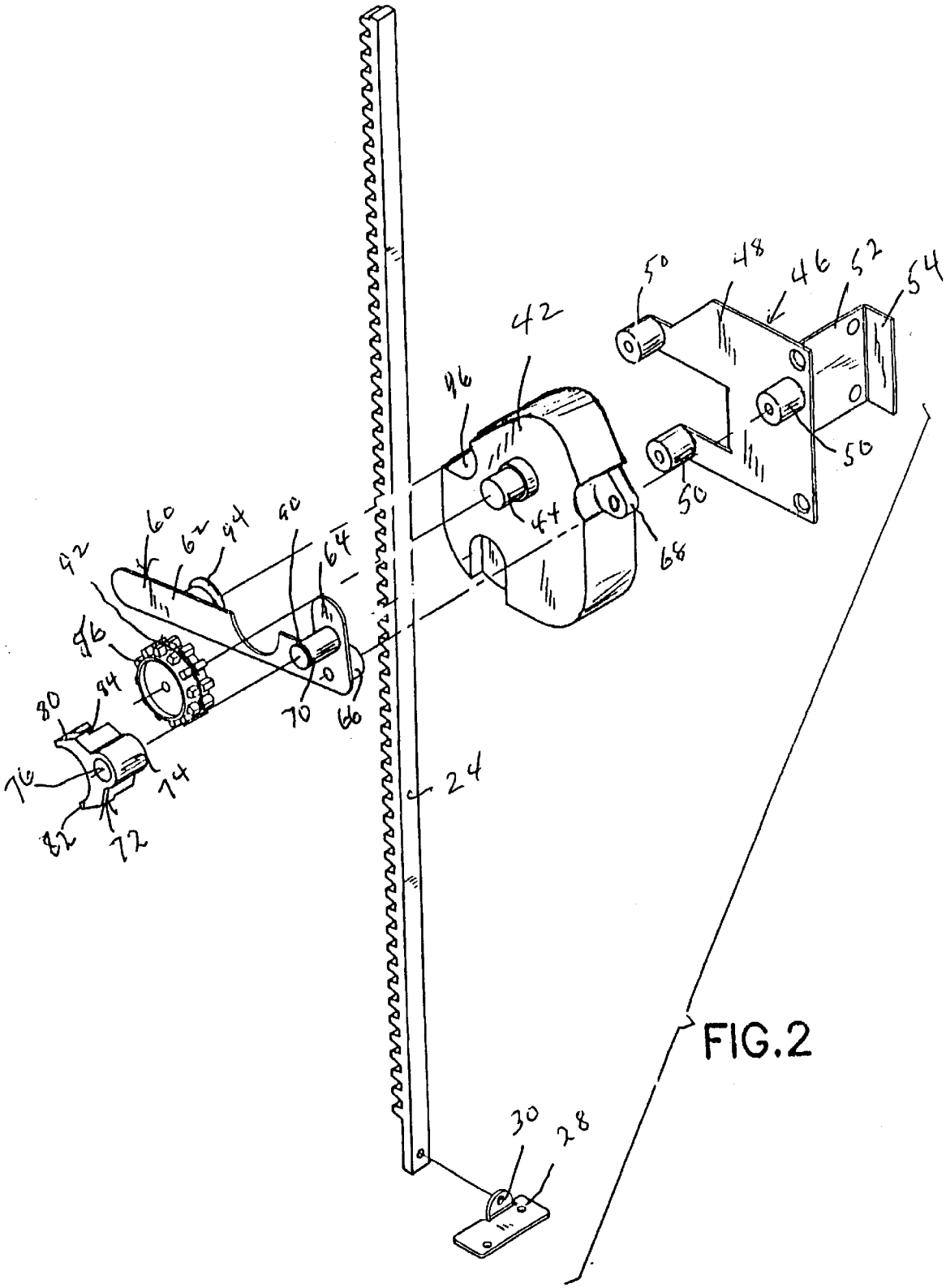
FIG. 2 is an exploded view of the embodiment from the right side and behind with respect to the FIG. 1 showing.

To help assure against lateral infringement between the rack and the spur 56, the teeth of the spur are formed with central slots 91 and receive an O-ring 92 (FIG. 2). The teeth of the rack are similarly formed with slots 58 (FIG. 1). Thus, when the rack and spur are solidly engaged (FIG. 3B), the O-ring provides a resilient retainer, assuring that the rack will not move sideways off the spur.

Outward from the pivot the engagement lever 60 is formed with a cut-out 93 to accommodate the spur 56, and a cylindrical projection 94 fixedly supported on the lever. The housing 42 is formed with a mating recess 96.

Referring now to FIGS. 3A and 3B, when it is desired to engage the rack and spur gear, the engagement lever 60 is pulled down so that the guide 72 urges the teeth of the rack 24 into meshing with the teeth of the spur gear 56. Full engagement is effected by having the projection 94 snap into the recess 96 of the housing (FIG. 3A). The motor in the housing 42 can then be activated to drive the spur 56 to elevate or lower the rack 24. The sash 18 moves correspondingly. Suitable limiting devices for the travel of the rack may be provided in the form of an ending of the teeth segments; that is, the spur can drive the rack 24 past the zone in which the teeth project to a void spot at which the spur 92 simply idles.

If it is desired to disengage the rack from the gear so that the sash may be moved up or down, not being impeded by the drag of having to rotate the spur and the motor, the guide lever 60 may be raised to the position of 3A where upon the rack guide draws the rack 24 away from the spur 56 to the position shown. Alternatively, the rack guide may be drawn totally off the spindle 70 and the rack may be pivoted about its bracket 28 to lie on the shelf 20 till it is needed again.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A sliding sash drive assembly comprising:

a. a rack gear having a side formed with teeth and adapted to be connected to the sash parallel to the direction of sash movement and held against longitudinal movement with respect to the sash, b. A drive unit adapted to be mounted on a frame element associated with the sash and extending in the direction of intended travel of the sash, the unit comprising:

1) a housing containing a drive motor having an output shaft and spur exterior of the housing, 2) an L-shaped engagement lever having a long arm and a short arm, a point on the short arm being pivotally attached to the housing or an axis parallel to the output shaft, 3) a rack guide pivotally attached to the short arm at a point spaced along the short leg from the first point, the guide embracing the rack from opposite sides and adapted, as the long leg is pivoted, to move the rack into engagement with the spur or out of engagement with the spur.

2. An assembly as claimed in claim 1 wherein the long leg of the L-shaped engagement lever and the housing are formed with cooperating detent elements adapted to releasably hold the long leg in a position whereat the rack engages the spur gear.

3. An assembly as claimed in claim 2 wherein the cooperating detents comprise a projection on the long leg of the lever and a recess in the housing adapted to releasably receive the projection.

4. An assembly as claimed in claim 3 wherein the projection has an axis parallel to the axis of the spur.

5. An assembly as claimed in claim 1 wherein the rack guide is U-shaped and pivoted to the lever at the bight of the "U" with the legs of the "U" engaging a side of the rack opposite the teeth.

6. An assembly as claimed in claim 5 wherein the legs of the guide are notched to receive the rack and serve as a guard.

7. An assembly as claimed in claim 1 wherein the spur is formed with teeth which are centrally notched and the notches receive the O-ring and the rack teeth are also centrally notched to accommodate the O-ring as the spur rotates.

8. An assembly as claimed in claim 1 wherein the long leg of the lever is formed with a cutout to accommodate the spur.

9. An optionally powered sash window comprising:

a. a frame, b. a window sash slidable in the frame in opposite directions.

c. a rack gear having a side formed with teeth and adapted to be connected to the sash parallel to the direction of sash movement and held against longitudinal movement with respect to the sash, d. A drive unit mounted on an element of the frame extending in the directions, the unit comprising:

1) a housing containing a drive motor having an output shaft and spur exterior of the housing, 2) an L-shaped engagement lever having a long arm and a short arm, the lever being pivotally attached to the housing at the vertex of the "L" on an axis parallel to the output shaft, 3) a rack guide pivotally attached to the short arm at a point spaced along the short log from the vertex, the guide embracing the rack from opposite sides and adapted as the long leg is pivoted to move the rack into engagement with the spur or out of engagement with the spur.

* * * * *